US007999697B2

(12) United States Patent
Jia et al.

(10) Patent No.: US 7,999,697 B2
(45) Date of Patent: Aug. 16, 2011

(54) WLAN-BASED NO-STOP ELECTRONIC TOLL COLLECTION SYSTEM AND THE IMPLEMENTATION THEREOF

(75) Inventors: Lin Jia, Beijing (CN); Yong Li, Beijing (CN); Xiang Gao, Beijing (CN)

(73) Assignee: Beijing Watch Data System Co., Ltd., Beijing (CN)

( * ) Notice: Subject to any disclaimer, the term of this patent is extended or adjusted under 35 U.S.C. 154(b) by 489 days.

(21) Appl. No.: 11/920,695

(22) PCT Filed: Aug. 3, 2006

(86) PCT No.: PCT/CN2006/001954

§ 371 (c)(1), (2), (4) Date: Aug. 26, 2008

(87) PCT Pub. No.: WO2007/059673

PCT Pub. Date: May 31, 2007

(65) Prior Publication Data

US 2009/0121898 A1 May 14, 2009

(30) Foreign Application Priority Data

Nov. 25, 2005 (CN) ..... 2005 1 0124141

(51) Int. Cl.
*G08G 1/00* (2006.01)
*G08G 1/065* (2006.01)

(52) U.S. Cl. ..... 340/928; 340/909

(58) Field of Classification Search ..... 340/928, 340/909

See application file for complete search history.

(56) References Cited

U.S. PATENT DOCUMENTS

2003/0053433 A1* 3/2003 Chun ..... 370/338
2003/0053564 A1* 3/2003 Kim et al. ..... 375/326
2006/0071816 A1* 4/2006 Tang et al. ..... 340/928

FOREIGN PATENT DOCUMENTS

CN 1188288 A 7/1998
CN 1598880 A 3/2005
CN 1598882 A 3/2005

OTHER PUBLICATIONS

International Search Report issued in Patent Application No. PCT/CN2006/001954 dated on Nov. 30, 2006.

* cited by examiner

*Primary Examiner* — Travis Hunnings
(74) *Attorney, Agent, or Firm* — McDermott Will & Emery LLP

(57) ABSTRACT

A no-stop electronic toll collection (ETC) system based on WLAN is disclosed in the present invention. The system includes an on-board equipment, roadside equipments, a multiple access carriageway control system and a toll balance center. The communication is implemented between the on-board equipment and the roadside equipments according to the demand determined by the wireless local network protocol. The system offered in the present invention applies several technology means to effectively overcome the technology prejudice that the WLAN technology is not suitable for the ETC system. Compared with the existing technology, the present ETC system has the advantages of low cost, high efficiency, complete function and good performance index, therefore the present invention is very meaningful for the application and extension of the ETC system and the improvement of the industrial technology.

19 Claims, 4 Drawing Sheets

WLAN-BASED NO-STOP ELECTRONIC TOLL COLLECTION SYSTEM AND THE IMPLEMENTATION THEREOF

RELATED APPLICATIONS

This application is the U.S. National Phase under 35 U.S.C. §371 of International Application No. PCT/CN2006/001954, filed on Aug. 3, 2006, which in turn claims the benefit of Chinese Application No. 200510124141.5, filed on Nov. 25, 2005, the disclosures of which Applications are incorporated by reference herein.

TECHNICAL FIELD

The present invention relates to a no-stop electronic toll collection (ETC) system for highway or urban roads, and more specifically to a no-stop ETC system based on wireless local area network (WLAN), and meanwhile, also to the method for implementing this system. The present invention belongs to the technical field of intelligent traffic system (ITS).

BACKGROUND OF THE INVENTION

With the rapid development of the national economy, the conflict between the increasing vehicle population and the limited road area is increasingly outstanding. In order to solve this conflict, a most important part, besides intensively building roads, is increasing the utilization efficiency of the existing roads. On this background, the ITS is becoming a hot point of research and development in today's world.

No-stop ETC system and its technology is an important part of the ITS and an important technical means to solve the problems in toll roads, such as traffic congestion, traffic jam, and improve the operation security and efficiency of the existing roads. ETC system is especially suitable for the environments such as highways or bridges and tunnels with heavy traffic. With this system, toll can be implemented without stopping the vehicles, and the vehicles are allowed to pass with high speed, so the traffic capacity of the highway is largely increased; Electronic of the highway toll can decrease the cost of toll management and help to increase the operative efficiency of the vehicles; Due to the large scale increase of the traffic capacity, the size of toll station can be decreased and the capital construction cost and management cost can be saved. According to the related research, the traffic capacity of the existing toll roads can be increased for about 4 to 5 times if the ETC system is applied, thereby saving a large amount of manpower, material resources and financial power. According to the statistics of the related institutions, more than one hundred million yuan for cost of gasoline which is wasted during stopping and waiting for tolling can be saved annually only in the area of Guangzhou.

A lot of research has been done in the field of ETC, for example, Chinese patent ZL99118307.X disclosed a toll collection system which collecting the toll by equipping the vehicle with an on-board unit loaded with an IC card to wirelessly communicate with the device installed at the toll station. The device at the toll station can send the information representing if there is or how many wireless communication devices on the next stage to the on-board unit by wireless communication, and after communicated with all wireless communication devices in the device at the toll station, writing are processed on the IC card. Additionally, the patent application 03145082.2 disclosed a card processing system and method for the toll roads. The toll system includes: card processor installed at the toll station and used to process the toll, having an antenna unit to wirelessly communicate with the IC card for card processing; the antenna unit installed on both sides of the road of the toll station to wirelessly communicate with the IC card for card processing; the type-recognition device used to recognize the type of the vehicle driving in the driveway; And the driveway controller used to select the antenna unit for card processing and controlling the card processing according to the recognized type of the vehicle. There are similar patents or patent applications. But the wireless communication technology applied by the present ETC systems is generally microwave non-touch ID card identification technology, namely the RF identification technology (RFID) used in the ETC system. However, the cost of this microwave non-touch ID card identification system, especially the roadside equipment (RSE), is very high. The current price of RSE is hundreds of thousands RMB, and the cost of the whole system even reaches millions of RMB. It can be seen that cost becomes an important bottleneck to restrict the large-scale application and the development of the present ETC system.

On the other hand, with the development of the communication technology, wireless local area network (WLAN) technology is gradually becoming mature. WLAN is the computer local area network applying wireless media transmission, and the standard applied is IEEE802.11 serial. In the range of medium and short distance, WLAN technology can offer high efficient, good quality and low cost broadband access services for the mobile or semi-mobile users. Compared with the RFID technology, WLAN technology has the outstanding advantages of simple installation, short construction period and low cost. However, WLAN technology is mainly applied for the interconnection of WLAN in the range of 50 m to 100 m, and the network terminals are in the condition of static or low-speed moving (lower than 5 km/h). While in the ETC system, the moving speed of the mobile terminal is generally higher than 30 km/h. Therefore, WLAN technology is generally considered as not suitable for the ETC system. There is no precedent for applying WLAN for wireless communication in the present ETC system.

CONTENT OF THE INVENTION

The object of the present invention is to offer an implementation scheme of ETC system based on WLAN, which is applying WLAN chip and technology to replace the corresponding RFID technology in the ETC system, to overcome the above-mentioned technology prejudice.

In order to achieve the object, the present invention applies the following technology scheme:

A no-stop ETC system includes the on-board equipment, roadside equipment, multiple access carriageway controlling system and toll balance center, wherein said on-board equipment is installed in the vehicle, several said roadside equipment are respectively connected with the multiple access carriageway controlling system; Said multiple access carriageway controlling system reads and processes the related data uploaded by the roadside equipment, and sends the processed information to the toll balance center; which is characterized in that:

A wireless network card is installed in said on-board equipment, and a wireless network card and a wireless access point are installed in said roadside equipment, and said on-board equipment wirelessly communicates with the roadside equipment through said wireless network card and the wireless access point;

Said on-board equipment communicates with the wireless access point of the roadside equipment via the wireless network card, using WLAN standard protocol.

Preferably, said WLAN protocol includes but not limited to IEEE802.11 protocol.

Preferably, said on-board equipment includes on-board unit and external component; wherein the on-board unit includes wireless network card, power supply unit, and system interface unit which is used to store the vehicle data information and connect with the storage card Read-Write device, and said external component includes storage card media for storing the user data, Human Computer interface and storage card Read-Write device, and said on-board unit and external component exchange data with each other.

Preferably, the wireless network card of said on-board unit includes baseband processing unit, RF processing unit and antenna feeding unit; wherein said power supply unit and the system interface unit are respectively connected with the baseband processing unit, and after the system interface unit obtains data from the external component, it sends the data to the baseband processing unit, which sends the processed data to the RF processing unit, and the data is externally output via the antenna feeding unit.

Preferably, said RF processing unit also has a frequency converter.

Preferably, said wireless access point applies a directional antenna.

Preferably, the horizontal angle in the beamwidth of said directional antenna is limited to the width of one carriageway.

A method to implement the no-stop ECT system and the ETC system includes the on-board equipments, roadside equipment, multiple access carriageway controlling system and toll balance center, wherein there are several roadside equipments; Said on-board equipment is installed in the vehicle, several said roadside equipment are respectively connected with the multiple access carriageway controlling system; Said multiple access carriageway controlling system reads and processes the related data uploaded by the roadside equipment, and sends the processed information to the toll balance center, which is characterized in that:

Said on-board equipment communicates with said roadside equipment using WLAN standard protocol.

Preferably, said WLAN protocol includes but not limited to IEEE802.11 protocol.

Preferably, during the communication between said roadside equipment and the on-board equipment, a modulation mode combining orthogonal frequency division multiplexing and binary phase shift keying is applied for the baseband signal.

Preferably, during the process of said baseband signal, firstly baseband signal modulated by the binary phase shift keying is subjected to process of orthogonal frequency division multiplexing spread spectrum with several sub-carriers, and then enter the RF part; in the RF part, the processed baseband signal is frequency converted and then transmitted.

Preferably, during said process of frequency converting, the frequency of said baseband signal is modulated to 5.8 GHz.

Preferably, during the communication between said roadside equipment and the on-board equipment, MAC layer communicates based on carrier sensing the multiple access/collision avoidance protocol.

Preferably, in said carrier sensing the multiple access/collision avoidance protocol, each node is designated with a peculiar competitive time slice, and if each node has information to be sent in the corresponding time slice, a transmission starts, and after other nodes detect the information transmission, the time slice will be stopped to propel, and all nodes resume the time slice propelling after the transmission is completed.

Preferably, in said carrier sensing the multiple access/collision avoidance protocol, the competitive time slice of the first node, which accesses the WLAN, in the front of the time sequence, automatically changes into a priority time slot which priors to other time slots, and the information of the first node in the front of the time sequence is prior to be transmitted.

A wireless access point antenna in the no-stop ETC system, and the ETC system includes the on-board equipments, roadside equipment, multiple access carriageway controlling system and toll balance center, wherein there are several roadside equipments; Said on-board equipment is installed in the vehicle, several said roadside equipment are respectively connected with the multiple access carriageway controlling system; Said multiple access carriageway controlling system reads and processes the related data uploaded by the roadside equipment, and the processed information is sent to the toll balance center, which is characterized in that:

Said wireless access point antenna is a directional antenna for both transmitting and receiving.

Preferably, the beamwidth of said antenna is not larger than 5 degree in the horizontal direction.

Preferably, the beamwidth of said antenna is between 10 and 30 degree in the vertical direction.

The WLAN-based ETC system offered in the present invention applies several technology means to effectively overcome the technology prejudice that the WLAN technology is not suitable for the ETC system. Compared with the existing ETC system applying RF identification technology, the present ETC system has the advantages of low cost, high efficiency (high information transmission speed and operative efficiency), complete function and good performance index, therefore the present invention is very meaningful for the popularization and application of the ETC system and the improvement of the industrial technology.

DETAILED DESCRIPTION OF THE EMBODIMENTS

The embodiment of the present invention will be described in further detail with reference to the accompanying drawings.

Figure 1:
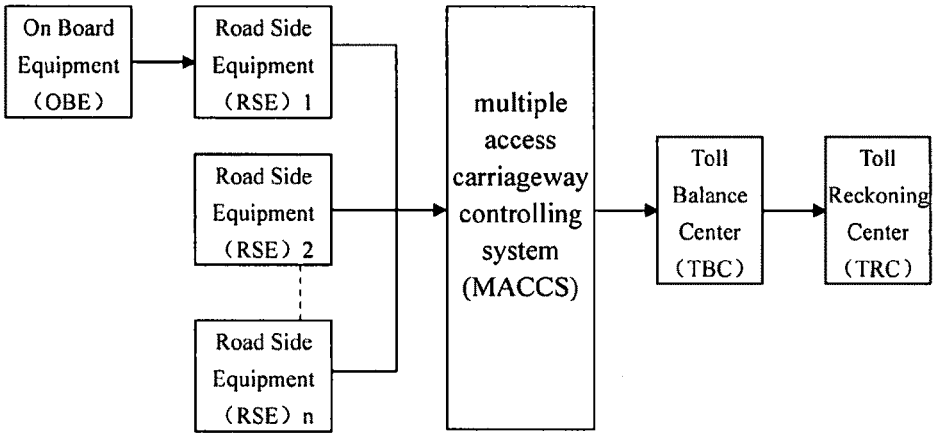
FIG. 1 is a logical frame diagram of said WLAN-based ETC system in accordance with the present invention.

Similar to the fundamental architecture of the existing ETC system, said WLAN-based ETC system of the present invention also includes the following fundamental functional modules: on-board equipment (OBE), roadside equipment (RSE), multiple access carriageway controlling system (MACCS), toll balance center (TBC) and the toll reckoning center (TRC), and its logical block diagram is shown in FIG. 1. Wherein there are several road equipments and the roadside units are respectively distributed on both sides of the carriageway, and the wireless access point AP is installed on the upper space on the road. The on-board equipment is installed in the vehicle, and exchanges data with the roadside equipments using wireless method. Several roadside equipments respectively access to the multiple access carriageway controlling system. Said multiple access carriageway controlling system is the control center of the whole ETC system. It reads and processes the related data uploaded by the on-board equipment and determines what type of vehicle is passing the toll station, and sends the processed information to the toll balance center. The toll balance center is connected with the toll reckoning center, and the toll reckoning center does the final reckoning process for the associated toll.

The structure and function of each above-mentioned functional module will be described in the following.

Figure 2:
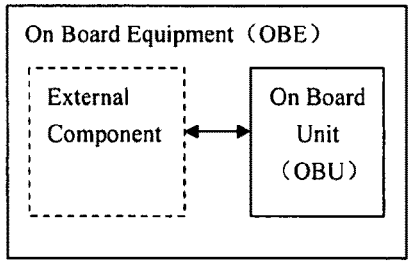
FIG. 2 is a theory structural diagram of the on-board equipment OBE.

The function of the on-board equipment (OBE) is transmitting and receiving information, comprising receiving the current payment information or transaction condition information, obtaining the broadcast information and sending information to the roadside unit. In the present invention, different from the on-board equipment used in the existing ETC system, said on-board equipment does not concentrate all units in a body, while applies the distributed structure, including two parts of on-board unit (OBU) and the external component: wherein the OBU is used for storing the vehicle data information, including existence, localization, license plate, type of the vehicle, as well as the unique identification code of the vehicle; the external components includes the external storage card medium for storing the user information (including fund), human computer interface (such as display, keyboard, voice and LED), storage card read/write device. These two parts exchange data with each other, and the block diagram of the specific principle can be referred to as FIG. 2.

Figure 3:
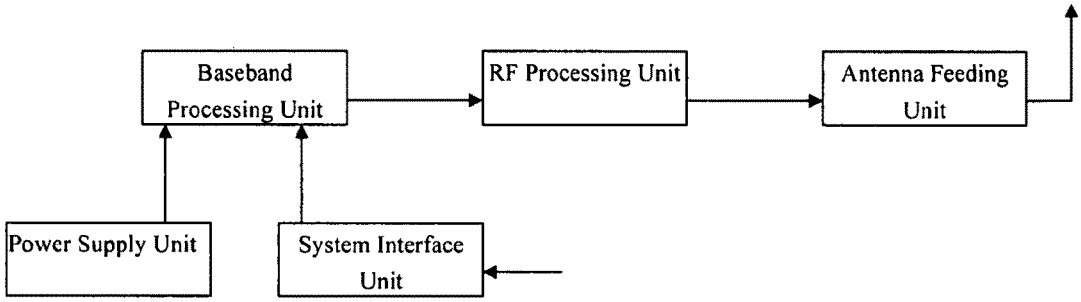
FIG. 3 is a schematic diagram of the specific structure of the on-board unit OBU.

The specific structure of the on-board unit (OBU) is shown as FIG. 3, which includes baseband processing unit, RF processing unit, antenna feeding unit, power supply unit, system interface unit. Wherein the power supply unit and the system interface unit connects respectively with the baseband processing unit. After the data is obtained by the system interface unit, the data is sent to the baseband processing unit, which again sends the processed data to the RF processing unit and the data is outputted by the antenna feeding unit. The function of the OBU is to obtain the user information stored in the external component and communicate with the roadside unit (RSU), and exchange data information such as the related protocol data, vehicle classified data, electronic wallet or accounting data. Different from the existing ETC system, the communication between them confirms to the specification of the international standard protocol CSMA/CA (carrier sensing multiple access/collision avoidance) applied by the wireless local network (WLAN). Regarding to this point, it will be further described in the following. The wireless network cards consisting of the baseband processing unit, RF processing unit and the antenna feeding unit are respectively installed in the OBU and RSU, that is, one wireless network card is installed in OBU and RSU respectively. Wireless access point (AP) is the connection device to ensure the communication between OBU and RSU, but it is included in the RSE, that is RSU transmits RF signal, and the signal can only be received by the OBU in the operation range of AP after it passes AP; the feedback signal of the OBU is also received by RSU after it passes AP.

Figure 4:
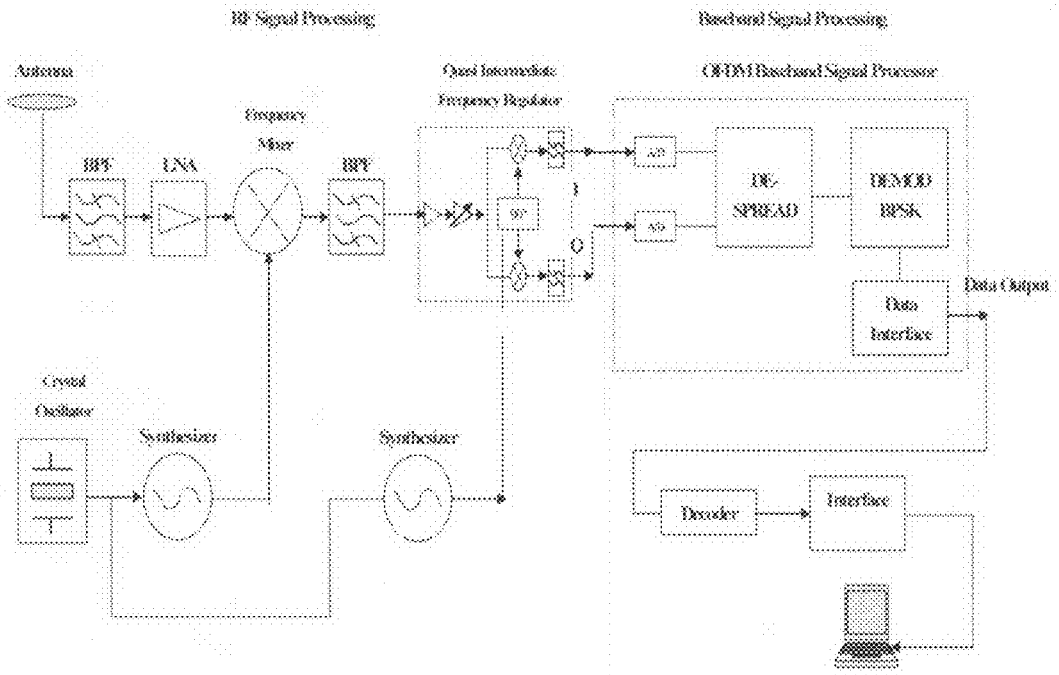
FIG. 4 is a schematic diagram of the signal receiving of the on-board unit OBU.

FIG. 4 is the operation schematic diagram of the signal receiving of the foregoing OBU. As shown in FIG. 4, in the RF signal processing part, after the signal from AP is received by the antenna, after the signal is passed the band pass filter (BPF) and low noise amplifier (LNA), a frequency mixer is followed. On the other hand, the oscillation signal created by the crystal oscillator is fed into the mixer after through the synthesizer. The mixed signal is fed into a quasi intermediate frequency regulator after through another BPF. While another channel oscillation signal created by the crystal oscillator is also fed into the quasi intermediate frequency regulator after passing the synthesizer. The above is the signal processing procedure of the RF signal processing part. In the baseband signal processing part, the foregoing RF signal applies the processing method combining the orthogonal frequency division multiplexing (OFDM) and binary phase shifting keying (BPSK), namely the orthogonal frequency division multiplexing baseband signal processor applies BPSK to modulate the signal, after the related process is performed, the output data is fed to the external components after decoded by the system interface unit. According to the received data, the external component feeds back the related stored user data to the system interface unit. After that, the data along with the vehicle data information stored in the system interface unit is transmitted by the antenna via the signal processing procedure inverse to what is described in the above.

Figure 5:
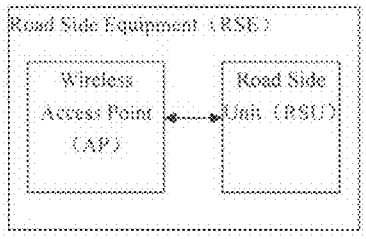
FIG. 5 is a block diagram of the principle of the roadside equipment RSE.
Figure 6:
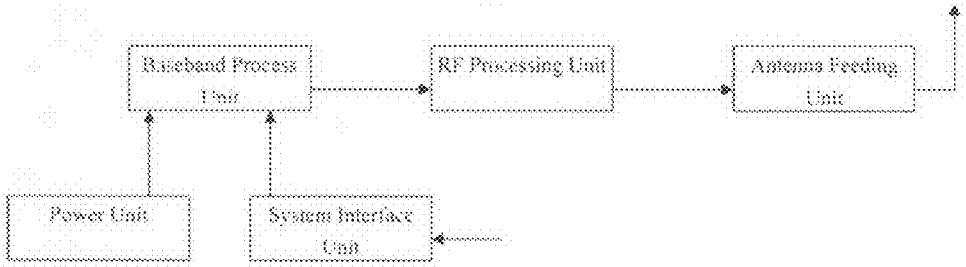
FIG. 6 is a structural diagram of the roadside unit RSU.
Figure 7:
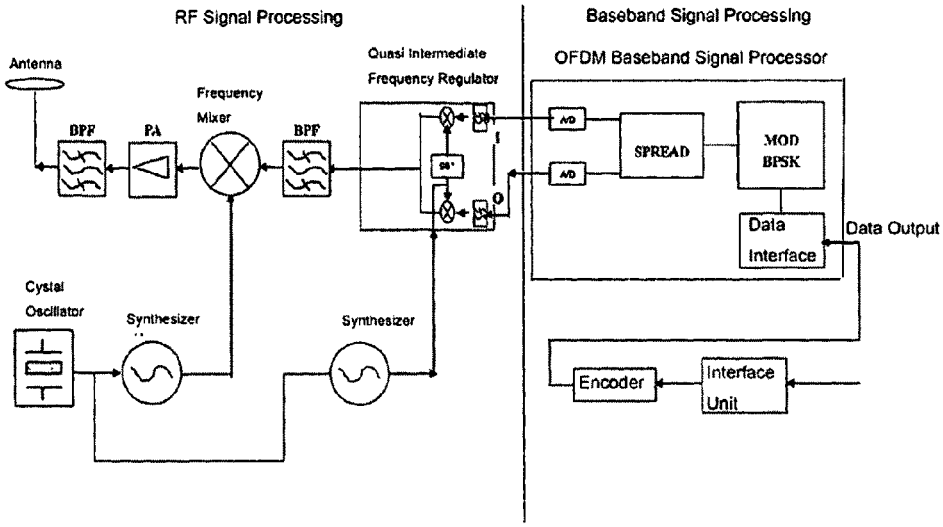
FIG. 7 is the schematic diagram of the signal sending of the roadside unit RSU.

FIG. 5 is the structure block diagram of the principle of the roadside equipment RSE. In the present invention, different from the roadside equipment used in the existing ETC system, this roadside equipment does not need to lay underground sensor for determining whether there is mobile terminal passing, while applying the distributed structure which includes two parts of wireless access point (AP) and the roadside unit (RSU). Wireless access point (AP) is the connection device to ensure the communication between OBU and RSU, that is RSU transmits RF signal, and the signal can only be received by the OBU in the operation range of the AP after it passes the AP, and the transmitted signal by the OBU is also received by RSU after it passes the AP. FIG. 6 is the structure block diagram of the roadside unit RSU. As shown in FIG. 6, The function of the antenna feeding unit, RF processing unit and the baseband processing unit is the same as those of the OBU in FIG. 3, but the implementation is opposite; The power supply unit supplies power for the whole RSU; The system interface unit includes encoder and the hardware interface, after the data stream fed in the hardware interface is processed by the system interface unit encoder, it is transmitted to the baseband processing unit in the RSU. The roadside unit RSU is a component of the toll station equipment, and is used to communicate with the on-board unit (OBU). Each carriageway installs a roadside unit (RSU) to read existence, localization, license plate, type of the vehicle as well as the unique identifications code of the vehicle in the OBE on each corresponding carriageway and the user information (such as fund) in the external storage card medium, and send the obtained information to the multiple access carriageway controlling system (MACCS) for processing. FIG. 7 is the operative schematic diagram of the signal sending by the roadside unit RSU. From the circuit composition, the internal structure of the roadside unit RSU and on-board unit OBU is almost the same; the difference is that the flow direction of the signal is opposite, which will not be repeated herein.

Figure 8:
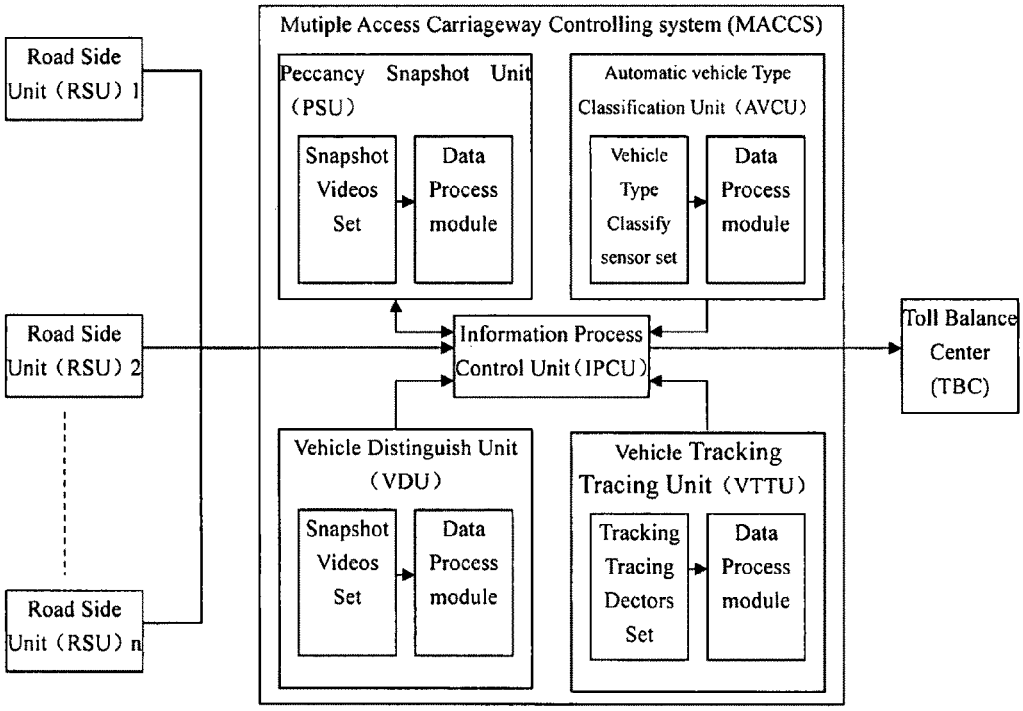
FIG. 8 is a structure block diagram of the multiple access carriageway controlling system (MACCS).

The main part of the equipment in the toll station—multiple access carriageway controlling system (MACCS) will be introduced in the following. The system is used to process various data information offered by RSU on each carriageway, and send the toll information to the toll balance center (TBC) for balance. As shown in FIG. 8, it includes the following functional sub-modules: information process controlling unit (IPCU), automatic vehicle type classification unit (AVCU), vehicle tracking tracing unit (VTTU), vehicle license plate identification unit (VDU) and peccancy snapshot unit (PSU). Wherein the data information (existence, localization, license plate, type of the vehicle as well as the unique identifications code of the vehicle, and the user information (such as fund) in the external storage card medium) from each roadside unit (RSU) is directed to the information process controlling unit (IPCU) in the multiple access carriageway controlling system (MACCS) for classification and storage; Meanwhile, a set of vehicle type classification sensors on each carriageway in automatic vehicle type classification unit (AVCU) automatically identify the type of the passing vehicle and send the obtained information to the corresponding data information processing module, then the vehicle type information collected by the data information processing module is sent to the information process controlling unit (IPCU); A set of tracking tracing detectors on each carriageway in vehicle tracking tracing unit (VTTU) automatically trace and identify the driving tracking of the passing vehicle, and send the obtained information to the corresponding data information processing module, then the vehicle tracking information collected by the data information processing module is sent to the information process controlling unit (IPCU); A set of snapshot videos on each carriageway in vehicle license plate identification unit (VDU) automatically shoot and identify the license plate of the passing vehicle, and send the obtained information to the corresponding data information processing module, then the vehicle license plate information collected by the data information processing module is sent to the information process controlling unit (IPCU); If the passing vehicle is violated, then the set of snapshot videos on each carriageway in peccancy snapshot unit (PSU) automatically and real-time shoot and identify the passing vehicle, and send the obtained information to the corresponding data information processing module, then the vehicle tracking information collected by the data information processing module is sent to the information process controlling unit (IPCU); Thereafter, IPCU classifies, arranges and stores the obtained data information from AVCU, VTTU, VDU and PSU, and then compares this data information with the corresponding information from RSU to verify the type, license plate and tracking of the passing vehicle. Therefore, it can reliably determine, identify and validate whether the inherent identity of the passing vehicle is true or valid, and meanwhile, effectively prevent the peccancy of the passing vehicle. After the verification is finished, IPCU sends the unique identification code of the passing vehicle, user information (such as fund) in the external storage card medium, and the data information (fine) (if exist) of traffic violation punishment to the toll balance center (TBC) for corresponding data information processing.

Figure 9:
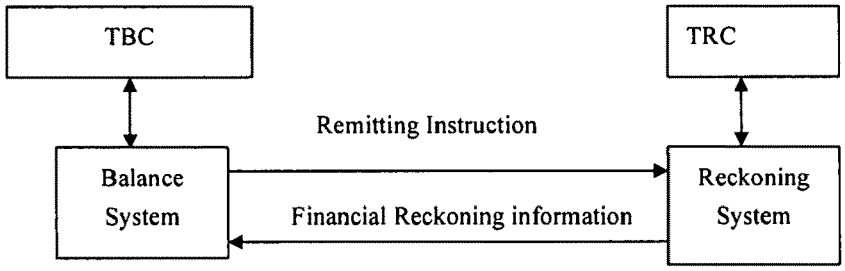
FIG. 9 shows the general financial process processed by the toll balance center (TBC) and the toll reckoning center (TRC).

FIG. 9 shows the general procedure for accounting process of the toll balance center (TBC) and the toll reckoning center (TRC).

The toll balance center (TBC) is also a component of toll station equipment, and essentially a computer processing background system, which is responsible for validation, statistics and balance of the created data by the passing vehicle using ETC system, and an entity to generate remitting instruction. After the data information from IPCU (the unique identification code of the vehicle, user information such as fund in the external storage card medium, and the data information such as fine of traffic violation punishment) is sent to the background computer processing system, the toll balance center (TBC) validates the unique identification code of the passing vehicle to read the identity of it, and then creates the toll data for payment this time (including the punishment toll data created by the traffic violation), and then it along with user information such as fund in the external storage card medium is offered to the remote toll reckoning center (TRC) for the corresponding toll.

The toll reckoning center is a remote data information processing terminal, an entity responsible for the fund and accounting reckoning, a financial institution such as a bank. After both the data from the toll balance center (TBC) and user information such as fund in the external storage card medium are reckoned, a remitting instruction is directly formed and sent to the toll reckoning center (TRC) which processes the remitting accounting, and then sends the feedback information that the accounting has been reckoned to the toll balance center (TBC).

In the above, the specific components and working principle of the WLAN-based ETC system in accordance with the present invention have been briefly described. In the following, the technical difficulties and the corresponding solution when the WLAN technology suitable for the environment of low speed moving is applied to the ETC system will be described in more detail.

Nowadays, WLAN technology has been already very mature, and the related technology standards have been widely accepted. It mainly aims at wireless access situations such as indoors wireless local area network and outdoors low speed (lower than 10 km/h) mobile terminal, and can provide high speed communication that the data transmission speed reaches above 11 Mbps, yet it does not support high speed mobility. Therefore, regarding to the outdoors high speed (higher than 10 km/h) mobile terminal, it is not suitable for WLAN technology to provide wireless access. In order to solve this problem, the basic solution of the present invention is that since ETC system does not require much for the data transmission speed (lower than 1 Mbps), therefore, the communication efficiency can be sacrificed for the benefits of reliability, working distance and cost.

Specifically, the related improvements embody into the following aspects:

1. During the communication between the roadside unit RSU and the on-board unit OBU, the modulation mode combining orthogonal frequency division multiplexing (OFDM) and binary phase shift keying (BPSK) is applied.

In ETC system, in order to guarantee the proper communication of the signal, the processes for the baseband chip and RF module are most important. Since the fundamental modules of the original WLAN chip have already been integrated, local improvement such as new encoding method and adjustment of the data modulation should be performed when it is applied to the ETC system.

Specifically, in the chip of processing baseband signal in OBU and RSU according to the present invention, it is the combination of orthogonal frequency division multiplexing (OFDM) and binary phase shift keying (BPSK) rather than the general DSSS (direct sequence spread spectrum) is applied. OFDM is a high speed transmission technology in wireless environment, the basic thought of which is to split the designated channel into several orthogonal sub-channels in the frequency domain, and in each sub-channel, a sub-carrier is used for modulation, and all sub-carriers are parallel transmitted. Since the definition of orthogonal frequency is used for distinguishing different carrier branches, the frequency span of each carrier is allowed to overlap; therefore, the spectrum utilization has been largely increased. BPSK is also a common method of digital signal modulation and can be widely used in many fields, such as satellites, microwave communications and broadcast TV. For example, in the existing ETC system, BPSK is applied for the processing of upstream data.

In the present invention, when RSU communicates with OBU, 52 sub-carriers are firstly used for OFDM spread spectrum processing of the BPSK modulated baseband signal, meanwhile, BPSK is applied to each sub-carrier of OFDM sign, wherein 4 of the sub-carriers are used to transmit pilot signal for channel tracing and synchronizing. The total length of each OFDM sign is 4 us, including a length of 0.8 us for protection interval. And then it enters into the RF part; In the RF signal processing part, a frequency converter is added to first-convert the baseband signal to the frequency range of 5.8 GHz, and then the signal is frequency-mixed and processed by the power amplifier, and then transmitted by the antenna-feed unit. The RF signal is received via the bridge connection of the wireless access point AP in RSE. Herein, the signal is modulated to 5.8 GHz, because 5.795-5.815 GHz is defined as the frequency range of communication by the national standard of the existing ETC system.

2. Design of the WLAN-based transmitting/receiving antenna

In mobile communication technology, the design of antenna is very important. Especially when the WLAN technology, which is suitable for applications in low speed environment, is applied to the ETC system in high-speed environment, the existing antenna technology can not be directly used. In order to guarantee the reliable and stable communication between OBU and RSU in ETC system, the practical physical channel is detailed and correctly estimated, and the right channel module is built; Also, the influence of many factors, such as all kinds of decay, effects and the speed of the mobile terminals are also considered; The power loss in the uplink and downlink are calculated and analyzed, and the channel capacity and system capacity of the whole ETC system are determined, therefore the definite design of the antenna and the performance parameters are offered. Then the manufacture of the antenna is performed.

In the following, take an access point AP directional antenna suitable for 802.11a standards as an example, the specific design scheme and the related demonstration process of the antenna are described in more detail.

Firstly, the channel module related to design should be determined. Since the physics channel environments of the ETC system communication mostly are flat and wide highways, the shelters on both sides are very few, therefore, it is not very complicated to get the exact channel estimation, and some classic outdoors channel model combining with the achievements in channel estimation of the practical physics channel in ETC system can be referred to build a channel model for ETC system, and then the power loss in uplink and downlink of the ETC system can be calculated and analyzed. In this embodiment, a classic bidirectional model is chosen as the channel model for this program, and the path loss is also calculated.

In order to make a 802.11a chipset (the working frequency is 5.725~5.825 GHz) applied in the ETC system (the working frequency is 5.795~5.815 GHz), the omni directional antenna using the AP of 802.11a standards should be changed to directional transmitting/receiving antenna to meet the requirement of the practical application of ETC system.

Herein the main technical specifications offered are:

a) Central frequency: 5.775 GHz; Bandwidth: 100 MHz
b) Polarization mode: horizontal polarization
c) VSWR: ≦1.5
d) Input resistance: 50Ω, N-type socket
e) Beamwidth (from the design of antenna, beamwidth (half power)=(35~65)×wavelength/the size of the antenna aperture):
   Horizontal direction: not larger than 5 degree
   Vertical direction: 10 degree~30 degree
f) Transmitting/receiving gain: about 12 dBi In the above parameters, only the beamwidth of the directional antenna should be described in detail. In the practical ETC system which we consider to use, the road condition is like this: the effective working distance of AP is 50 m, the height where the AP is placed is 4 m from the ground, the width of the road is 4 m, the distance for communicating information is generally 10 m~25 m (it is the distance that the mobile terminal is moving after a whole communication service is completed), therefore, through calculation, it can be seen that the beamwidth of the directional antenna is 30 degree in horizontal direction, which is a little larger (since when the beamwidth is very wide, the object that one antenna in one carriageway can not be achieved, meanwhile, since the directional antenna on the AP in different carriageways will communicate with the wireless network card which does not belong to its own carriageway, some unexpected tradeoff will occur, and since signals transmitted by different AP interfere with each other badly, the communication quality of each carriageway will greatly effected), it should be limited to about 5 degree in practical, while in vertical direction, about 10 degree is reasonable, therefore, in the requirement for 802.11 antenna parameters we set forth, 30 degree in horizontal direction of the beamwidth of the directional antenna should be changed to 5 degree, while 10 degree in vertical direction should be remained, therefore, the beamwidth should be limited to the width of a carriageway.

The specific calculation and analysis of the foregoing beamwidth is described as follows:

In vertical direction, if it is 10 degree, then the distance of trade is 50−(4/(tan 100))=27.315 m, which meets the system requirement that the distance for communicating information is generally in the range of 10 m~25 m; If it is 5 degree, the distance of trade is: 50−(4/(tan 50))=4.2798 m, which does not meet the system requirement that the distance for communicating information is generally in the range of 10 m~25 m; If it is 15 degree, the distance of trade is: 50−(4/(tan 150))=35.07188 m, which meets the system requirement that the distance for communicating information is generally in the range of 10 m~25 m; If it is 30, the distance of trade is: 50−(4/(tan 300))=43.0718 m, which meets the system requirement that the distance for communicating information is generally in the range of 10 m~25 m; From which we can see that at least 10 degree in vertical direction meets the requirement of the application system, but meanwhile, it should also less than 30 degree to prevent the power loss of the unnecessary AP transmission because of the too wide beamwidth.

In horizontal direction, 3 degree, 5 degree, 10 degree, 15 degree, 20 degree, 25 degree, 30 degree and 40 degree are respectively chosen, and the distances for trade are respectively:

$$50-(2/(\tan 30))=11.84\text{ m};$$

$$50-(2/(\tan 50))=27.14\text{ m};$$

$$50-(2/(\tan 100))=38.66\text{ m};$$

50−(2/(tan 150))=42.54 m;

50−(2/(tan 200))=44.51 m;

50−(2/(tan 250))=45.71 m;

50−(2/(tan 300))=46.54 m;

50−(2/(tan 350))=47.14 m;

50−(2/(tan 400))=47.62 m;

Since one antenna for one carriageway is needed for ETC system, the beamwidth in horizontal direction should not be too large (that is, the spread angle of the RF signal energy should not be too large), and also according to the requirement of the application system that the distance for communicating information is generally in the range of 10 m~25 m, it is determined the angle in horizontal direction of the beamwidth of the directional antenna should be in the range of 3 degree to 10 degree, while 5 degree is most suitable.

The next work is to estimate unlink and downlink of the transmission channel. Here the related parameters of the used AP chip and the terminal parameters of the wireless network card should be searched, which will be omitted here.

According to the associated parameters of the AP chip and wireless network card, the power level of the uplink and downlink when transmitting in the free space can be estimated.

The loss in free space:

$L_{fs}$=92.4478+20 lg $f$+20 lg $d$ (distance d is 0.05 km, frequency f is 5.8 GHz)

=92.4478+15.27−26.02

=81.6978 dB

Estimation of demodulation threshold and calculation of the spread spectrum gain ($E_b/N_c$+[PG]+[PD]):

From the equation PRmin=[Eb/Nc]+[K]+[PG]+[PD]+[T]+[NF]

Where:

Eb/Nc normalized signal to noise ratio

K Boltzman's constant −228.6 dB

T temperature of the system noise, chosen as 328° K (25.16 dB)

NF noise coefficiency of the receiver, chosen as 5 dB

PG spread spectrum gain

PD OFDM gain

The receiving sensitivity is −94 dBm in 1 Mbps, namely −124 dBW (BPSK 8% PRE), substituted the above-mentioned parameters, we have:

Estimation of demodulation threshold and calculation of the spread spectrum gain ($E_b/N_c$+[PG]+[PD]) is 74.44 dB For the transmission link, from the equation:

$$PT=[PR]-[GT]-[GR]+[Lfs]+[SM]$$

Where:

PR receiving sensitivity, chosen as −124 dBW (BPSK 8% PRE)

GT the gain of the transmitting antenna 0 dB

GR the gain of the receiving antenna 0 dB

Lfs transmission loss in free space 81.6978 dB

SM system margin

The transmitting power is known as 15 dBm±2 dBm, after the parameters are substituted, it can be calculated that:

$$15\pm2=-24-0-0+81.6978+SM$$

Therefore, the margin estimation of the original system is: SM=57.3022±2

For the receiving link, from the equation:

$$PR=[PT]+[GT]+[GR]-[Lfs]-[SM]$$

Where:

PT transmitting power, chosen as 15 dBm±2 dBm

GT the gain of the transmitting antenna 0 dB

GR the gain of the receiving antenna 0 dB

Lfs transmission loss in free space 81.6978 dB

SM system margin

The receiving sensitivity PR is chosen as −124 dBW (BPSK 8% PRE), after the parameters are substituted, it can be calculated that:

$$-124=15\pm2+0+0-81.6978-SM$$

Therefore, the margin estimation of the original system is: SM=57.3022±2

It should be mentioned that the foregoing calculation aims at the original single AP adding the wireless network card, and the corresponding working condition is 1 Mbps BPSK 8% PRE −94 dBm.

In order to decrease the error ratio, in the transmission condition of 1 Mbps BPSK, the margin required by the system is largely increased, and can definitely meet the system requirement.

If the AP omni directional antenna is replaced with the foregoing directional antenna, then in the practical working environment, transmitting antenna gain and the receiving antenna gain are increased. In the premise that other parameters are not changed, even the distance is increased for one time, namely the practical working distance of the wireless AP is 100 m, loss in free space is only increased for 6 dB, the receiving sensitivity will still not decrease, and the link budget of the system can totally meet the power requirement for receiving and transmitting the signals.

After the omni directional antenna is replaced with directional antenna, if the working condition is still 1 Mbps BPSK 8% PRE −94 dBm, then when the working distance of the wireless AP is increased, the wireless local area network can still properly work, and will not affect the initial conclusion of the above-mentioned experiment.

From the above calculation, it can be seen that for the directional antenna, the requirement for the amount of its gain is not very much; therefore, it is not necessary to require that the antenna has a very high gain (larger than 15 dB).

In the following, the capacity issue of the wireless local area network composed by AP and wireless network card when applying directional antenna will be further discussed:

Since the 802.11a chipset applied in ETC system, there is not too much requirement for the transmission speed of data, only 1 Mbps can works. Therefore, the working condition is chosen as 1 Mbps BPSK 8% PRE −94 dBm.

From the above power calculation of receiving/transmitting links, we can see that the system margin is SM=57.3022±2 dB. For common road condition, the loss of multi-path effect is about 30 dB, therefore, removing this part, the system margin is:

$$SM=57.3022\pm2-30=27.3022\pm2\text{ dB}$$

With the above result that the amount of demodulation threshold estimation and spread spectrum gain ($E_b/N_c$+[PG]+[PD]) is 74.44 dB, the total system margin is:

$$SM=27.3022\pm2+74.44=101.7422\text{ dB}$$

Therefore, since BPSK modulation is applied, the relationship between BRE and SNR realized by the system is as follows:

$$P_e = \frac{1}{2}\mathrm{erfc}\left(\sqrt{SNR}\right)$$

The parameter specifications by the communication system for reliability are: BER<$10^{-3}$, BER<$10^{-6}$. Therefore, if we choose $P_e=10^{-3}$, $10^{-6}$ respectively, then corresponding SNR can be obtained as follows:

$P_e=10^{-3}$: SNR=4.7961=6.81 dB;

$P_e=10^{-6}$: SNR=10.89=10.37 dB;

It can be seen that in order to guarantee the requirement for parameters that the communication BER of each user in the system should be lower than $10^{-3}$ or $10^{-6}$, each user should ensure that the output signal to noise ratio SNR is respectively 6.81 dB or 10.37 dB, namely, when BER specification of each user in the system is set to $10^{-3}$ or $10^{-6}$, the loss of each user will be 6.81 dB or 10.37 dB. And also since the total system power margin is 101.7422 dB, the result of the system capacity is as follows:

$P_e=10^{-3}$: 101.7422/6.81=14.94 results in: the system capacity is 14

$P_e=10^{-6}$: 101.7422/10.37=9.81 results in: the system capacity is 9

From the above calculation and analysis, we can see that it is totally feasible for WLAN technology applying into the high speed mobility situation represented by ETC if the antenna is done the necessary modification.

3. The protocol of CSMA/CA (carrier sensing multiple access/collision avoidance) is applied for communication in MAC layer In the present invention, it is not simply direct applying the associated technology of WLAN to the ETC system, but aimed to the characteristic of the high speed mobility of ETC system, doing the necessary modification for associated technology of WLAN to decrease the cost on the one hand, and meet the requirement of ETC system and each parameter on the other hand. In the wireless local area network composed by AP in RSE and the wireless network card in RSU and OBU in accordance with the present invention, nodes (referred to the roadside equipment and on-board equipment) only sends information after it detects that the network is available, and if there are two or more nodes collide with each other, then a block signal is started in the network to notify all collision nodes, synchronize node clock, start the competitive time slot (following the block signal, and its length is little larger than the transmission time delay along the network loop), use the competitive slot to avoid node collision.

Different from the dedicated short range wireless communication protocol (DSRC protocol) applied in most ETC system; the ETC system we design applies CSMA/CA (carrier sensing multiple access/collision avoidance) as the basis. The protocol combines the feature that the ETC system requires a lot for the moving speed of the mobile terminal (larger than 40 km/h), modifications are performed for the original CSMA/CA protocol to decrease the requirement for moving speed through shortening the communication time. Specifically, since there are limited vehicles are allowed in each carriageway of the ETC system, that is, the number of the nodes of the WLAN composed by the AP in the RSE and the wireless network card in OBU and RSU on each access carriageway is limited, the allocation mode of randomly adjusting the time slot according to the principle of minimum collision is not applied, while each node is designated with a specific competitive time slot, and if each node has information to be sent in the corresponding time slot, a transmission is started, and after other nodes detect the information transmission, the time slot propelling is stopped and resumed after the transmission is completed, therefore, the node collision can be avoided. Moreover, in order to shorten the communication time, the competitive time slice of the first node, which accesses the WLAN in the front of the time sequence, automatically changes into a priority time slot which priors to other time slots, and the information of the first node in the front of the time sequence is prior to be transmitted. When all time slots are out of work, the network is idle. And in order to guarantee the fairness and definability, the time slot circulates after each transmission.

Table 1 is a comparison of WLAN-based ETC system and the existing ETC system in PHY layer and MAC layer. Through this table, the fundamental condition of the MAC layer protocol applied in the present ETC system will be well understood.

| | Names | WLAN standards | The standard applied in the present ETC system |
|---|---|---|---|
| PHY layer | Frequency range | 5.725-5.825 GHz | 5.795-5.815 GHz |
| | Modulation mode | Uplink OFDM + BPSK<br>Downlink OFDM + BPSK | Uplink (write) BPSK<br>Downlink (read) ASK |
| | Output power | 15 dBm ± 2 dBm | 300 mW |
| | Working distance | 50 m~100 m | 10 m |
| | Data speed of transmission | Uplink<br>500 kbps~1 Mkbps<br>Downlink<br>500 kbps~1 Mkbps | Uplink 250 kbps<br>Downlink 500 kbps |
| | The encoding mode of data | K = 7(64states)the encoding speed of convolution code ½ ⅔ ¾ | NRZI<br>The content of electronic label coding includes:<br>The time of trade generating<br>Electronic label ID<br>The code of charging company<br>Data of the vehicle type |

-continued

| | Names | WLAN standards | The standard applied in the present ETC system |
|---|---|---|---|
| | | | Toll amount<br>Entering time<br>Code of the entering carriageway<br>Exiting time<br>Code of the exiting carriageway<br>Condition of trade |
| | Working mode | Active/Passive Passive | Active/Passive Passive |
| MAC Layer | CSMA/CA (carrier sensing multiple access/collision avoidance) protocol is applied in the wireless local area network. The essential is to use the time slot to avoid collision. The fundamental principle is: nodes can only transmit the information after they detect the availability of network, and if collision occurs in two or more nodes, a blocking signal is started in the network to notify all collision nodes, synchronizing node clock and starting the competitive time slot (the competitive time slot follows the blocking signal, and its length is a little longer than the transmission delay along with the network ring). The communication mode of CSMA/CA closely relates the division of time domain with the frame format to ensure that only one node sends data in a certain time point and realize the centralized control of the network system. The basic protocol of CSMA/CA is the lasting CSMA. CSMA/CA uses ACK signal to avoid the collision, that is, only the user terminal receives the ACK signal fed back in the network that the data is ensured to reach the destination rightly. Since it is relatively difficult for detecting collision in RF transmission network, the protocol use avoiding collision detection to replace the collision detection used in 802.3 protocol. Communication channel idle assessment (CCA) algorithm is used to determine whether the channel is available, which is performed by testing the power at the antenna aperture and determining the signal intensity RSSI. CSMA/CA uses RTS, CTS and ACK frame to reduce collision. The data privacy is the same as the wire equivalent privacy, which uses a 64-bit key and RC4 privacy algorithm. | | HDLC protocol is applied for communication.<br>The communication protocol applied for the carriageway antenna and the on-board electronic label in ETC system is DSRC. For ETC application, the system based on special short range communication has been fully standardized by ISO TC204/CEN TC278. The main features of the CEN/TC278 DSRC standard are: 5.8 GHz passive microwave communication, medium communication speed (500 Kbps for unlink and 250 Kbps for downlink), the modulation mode is ASK and BPSK. The 5.8 GHz DSRC is composed by three parts which are totally open, and need no agreement:<br>DSRC physical layer (EN 12253);<br>DSRC data link layer (EN 12795);<br>DSRC application layer (EN 12834/ISO 15628);<br>The special short range communication protocol DSRC belongs to the shared frequency range of the industry, scientific and medical. The associated standard is in constitution. Whose main parts are:<br>AVI working frequency<br>AVI working mode (active/passive)<br>system encoding mode<br>Data frame format and the correction mode<br>The short range communication DSRC protocol model<br>The basic technology of the 5.8 GHz system DSRC protocol ensures at least 10 m of bidirectional communication distance. The backscattering theory makes the downlink communication and the uplink communication will not interfere with each other so that the label can communicate reliably in the range of limited power. Therefore, the distance of writing and reading is the same in the system working according to the backscattering theory. |

In the above, the fundamental compositions and the specific implementation of the WLAN-based ETC system of the present invention have been introduced. The operation process of the present ETC system will be further introduced in the following.

Figure 10:
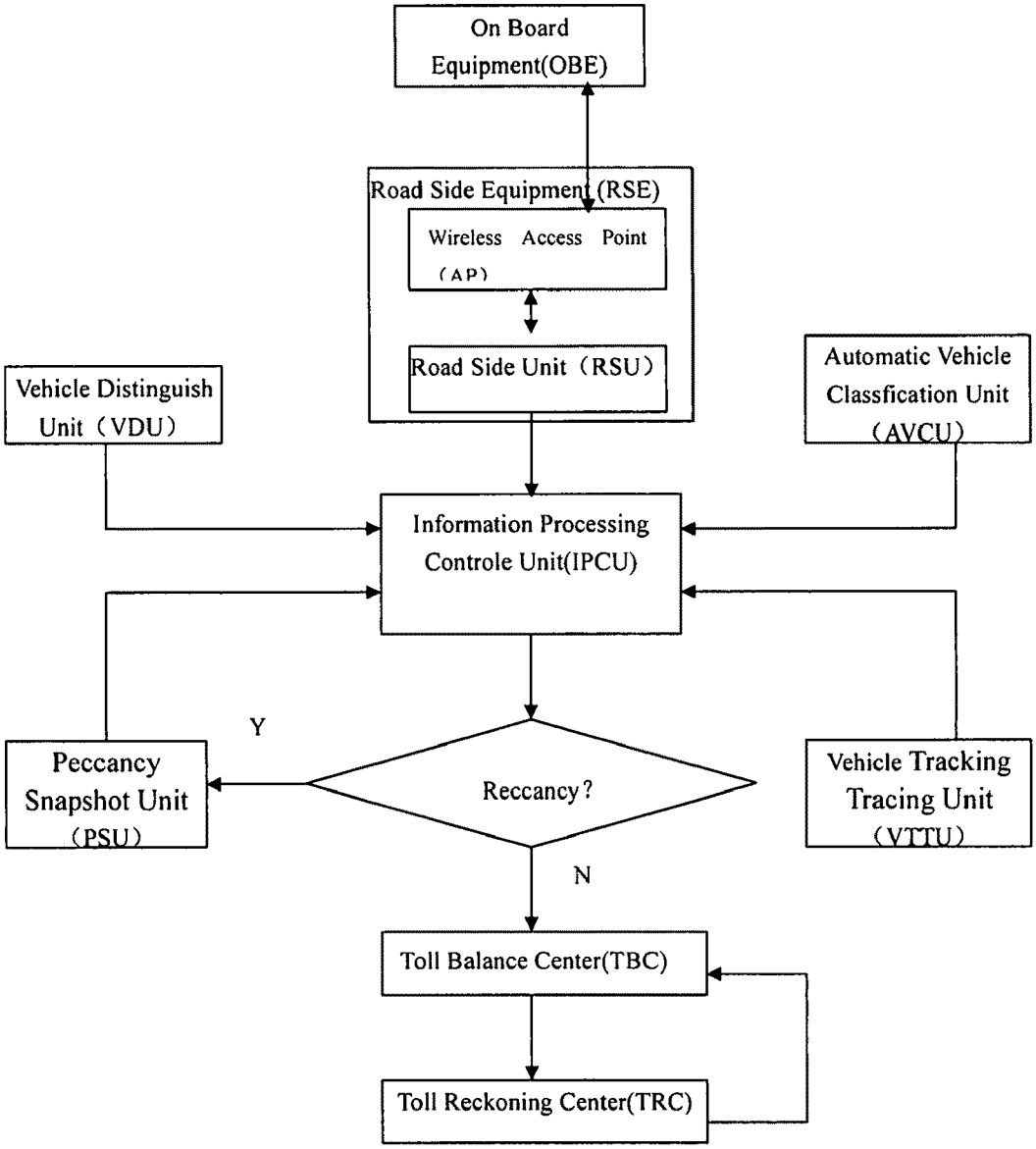
FIG. 10 is a schematic diagram of the operation of said ETC system in accordance with the present invention.

The ETC system offered in the present invention can provide stable and reliable wireless communication link (≧500 kbps); and realize no-stop toll with certain moving speed (≧40 kbps); meanwhile perform accounting and balancing and provide remitting measurement after the trade fails. The specific operation procedure is shown in FIG. 10, which includes the following steps:

1. Vehicle with on-board equipment (OBE) enters one the mutli-lanes of ETC system and reaches the recognizable range of the directional antenna on the AP of RSE of the lane (from the beginning to end, horizontally 100 m along the site of 50 m from the directional antenna on AP and vertically 4 m along the site of 2 m from the directional antenna on AP), when vehicle is 50 m away from the front directional antenna on AP, the following units start at the same time: roadside unit (RSU), information process controlling unit (IPCU), automatic vehicle type classification unit (AVCU), vehicle tracking tracing unit (VTTU), vehicle license plate identification unit (VDU) and peccancy snapshot unit (PSU);

2. When vehicle arrives in the range of 50 m from the front directional antenna on AP, RSU enters active state, sends RF read signal via directional antenna to establish communication with OBE on the vehicle, obtains the information of existence, localization, license plate, type of the vehicle as well as the unique identifications code of the vehicle, and the user information (such as fund) in the external storage card media; and then sends the obtained data information to the information process controlling unit (IPCU) of the multiple access carriageway controlling system (MACCS);

Synchronously, when vehicle arrives about 50 m from the front directional antenna on AP, A set of vehicle type classification sensor in AVCU enter active state, gather type information of the passing vehicle and send the obtained information to data information processing module, then fed to IPCU by the data information processing module;

Synchronously, when vehicle arrives about 50 m from the front directional antenna on AP, A set of tracking tracing detectors in VTTU enter active state, gather the tracking information of the passing vehicle and send to the data information processing module, then fed to IPCU by the data information processing module;

Synchronously, when vehicle arrives about 50 m from the front directional antenna on AP, A set of snapshot videos in VDU enter active state, gather the license plate information of the passing vehicle and send to the data information processing module, then fed to IPCU by the data information processing module;

Synchronously, when vehicle arrives about 50 m from the front directional antenna on AP, A set of snapshot videos in VDU enter stand-by state, if there is violation for the passing vehicle (such as tracking from one carriageway to another, refusing fees by forcing to pass, fund shortage in the shoring card), IPCU in MACCS sends start-up instruction to PSU, PSU transfers to active state from stand-up state on receiving the start-up instruction and real-time shoots the passing vehicle, then sends the whole image information including license plate of the passing vehicle to the data information processing module, and then fed to IPCU by the data information processing module;

3. IPCU in MACCS classifies the data information obtained from RSU and the data information obtained from AVCU, VTTU, VDU and PSU, and then comparatively recognizes these data information, that is, verify the type, license plate and tracking of the passing vehicle to determine the real identification and tracking information of the passing vehicle (to prevent the peccancy of the passing vehicle). After the verification is finished, IPCU sends the unique identification code of the passing vehicle, user information (such as fund) in the external storage card medium, and the data information (fine) of traffic violation punishment (if exist) to the computer processing background system, that is, toll balance center (TBC);

4. After obtaining the data information (the unique identification code of the passing vehicle, user information (such as fund) in the external storage card medium, and the data information (fine) of traffic violation punishment (if exist)) sent by IPCU, the toll balance center (TBC) will conduct corresponding data information processing: the toll balance center (TBC) firstly recognizes and confirms the unique identification code of the passing vehicle, reads the identification information of the vehicle, then produces the toll data information (including possible fine information if violation exists) due this time, and then the toll data information together with the user information (such as fund) in the external storage media is sent to the remote toll reckoning center (TRC) for the corresponding charge;

5. After obtained the data information (toll due this time for the passing vehicle) from the toll balance center (TBC) and user information (such as fund) from external storage media, the toll reckoning center (TRC) conducts accounting reckoning according to the remitting instruction directly formed and sent by TBC. After remitting accounting, TRC sends the feedback information that the accounting has been reckoned to the TBC.

Thus, the passing vehicle completes the whole procedure of non-stop toll based on ETC system of WLAN offered by present invention.

In the above the content of the present invention has been explained in detail via implementation of the specific embodiment of the present invention. For general technicians in the field, any evident modification without departure from substance of the present invention will be regarded as infringement of the present invention and result in corresponding legal liability.

The invention claimed is:

1. A no-stop electronic toll collection system comprising:

on-board equipment, including an on-board wireless network card, installed in a vehicle;

a multiple access carriageway controlling system;

plurality of roadside equipment, each including a roadside wireless network card and a wireless access point, connected with the multiple access carriageway controlling system; and a toll balance center, wherein said multiple access carriageway controlling system reads and processes data uploaded by the roadside equipment, and sends the processed information to the toll balance center;

said on-board equipment wirelessly communicates with the roadside equipment through said on-board wireless network card and the wireless access points without stopping the vehicle; and said on-board equipment communicates with the wireless access point of the roadside equipment via the on-board wireless network card, using a WLAN standard protocol.

2. The no-stop electronic toll collection system of claim 1, wherein said WLAN protocol includes but is not limited to the IEEE802.11 protocol.

3. The no-stop electronic toll collection system of claim 1, wherein said on-board equipment includes an on-board unit and an external component;

the on-board unit includes the on-board wireless network card, a power supply unit, and a system interface unit used to store the vehicle data information and connect with the storage card Read-Write device;

said external component includes a storage card medium for storing the user data, a Human Computer interface, and a storage card Read-Write device; and said on-board unit and external component exchange data with each other.

4. The no-stop electronic toll collection system of claim 3, wherein the on-board wireless network card includes a baseband processing unit, an RF processing unit, and an antenna feeding unit;

said power supply unit and the system interface unit are respectively connected with the baseband processing unit; and after obtaining data from the external component, the system interface unit sends the data to the baseband processing unit, then the baseband processing unit sends the processed data to the RF processing unit, and externally outputs the data via the antenna feeding unit.

5. The no-stop electronic toll collection system of claim 4, wherein said RF processing unit also has a frequency converter.

6. The no-stop electronic toll collection system of claim 1 is characterized in that:

said wireless access point uses a directional antenna.

7. The no-stop electronic toll collection system of claim 6 is characterized in that:

a horizontal angle of a beamwidth of said directional antenna corresponds to no greater than the width of one carriageway.

8. A wireless access point antenna for a no-stop electronic toll collection system of claim 1, the electronic toll collection system comprising on-board equipment installed in a vehicle, a plurality of roadside equipment, a multiple access carriageway controlling system, and a toll balance center, wherein said plurality of roadside equipment are connected with the multiple access carriageway controlling system; said on-board equipment wirelessly communicates with the roadside equipment without stopping the vehicle; said multiple access carriageway controlling system reads and processes related data uploaded by the roadside equipment, and sends the processed information to the toll balance center, wherein said wireless access point antenna is a directional antenna for both transmitting and receiving.

9. The wireless access point antenna in the no-stop electronic toll collection system of claim 8, wherein a beamwidth of said antenna is not larger than 5 degree in the horizontal direction.

10. The wireless access point antenna in the no-stop electronic toll collection system of claim 8, wherein a beamwidth of said antenna is between 10 and 30 degree in the vertical direction.

11. The no-stop electronic toll collection system of claim 1, wherein said on-board equipment wirelessly communicates with the roadside equipment while a speed of the vehicle is greater than 40 km/h.

12. A method to implement the no-stop electronic toll collection system of claim 1, the electronic toll collection system comprising the on-board equipment, the plurality of roadside equipment, the multiple access carriageway controlling system, and the toll balance center, the method comprising:

installing said on-board equipment installed in the vehicle;

connecting said plurality of roadside equipment with the multiple access carriageway controlling system;

reading and processing with said multiple access carriageway controlling system related data uploaded by the roadside equipment;

sending the processed information to the toll balance center; and communicating between said on-board equipment and said roadside equipment using WLAN protocol.

13. The method to implement the no-stop electronic toll collection system of claim 12, wherein said WLAN protocol includes but is not limited to the IEEE802.11 protocol.

14. The method to implement the no-stop electronic toll collection system of claim 12, wherein the communicating between said roadside equipment and the on-board equipment includes applying a modulation mode combining orthogonal frequency division multiplexing and binary phase shift keying for a baseband signal.

15. The method to implement the no-stop electronic toll collection system of claim 14, wherein the communicating includes modulating the baseband signal by the binary phase shift keying, subjecting the modulated baseband signal to a process of orthogonal frequency division multiplexing spread spectrum with several sub-carriers, and frequency converting and transmitting the processed baseband signal in an RF part.

16. The method to implement the no-stop electronic toll collection system of claim 15, wherein said frequency converting includes modulating the frequency of said baseband signal to 5.8 GHz.

17. The method to implement the no-stop electronic toll collection system of claim 12, wherein the communicating between said roadside equipment and the on-board equipment includes carrier sensing a multiple access/collision avoidance protocol for MAC layer communication.

18. The method to implement the no-stop electronic toll collection system of claim 17, wherein said carrier sensing the multiple access/collision avoidance protocol includes designating each node with a peculiar competitive time slice, starting an information transmission if a first node has information to be sent in its corresponding time slice, stopping advancement of time slices after other nodes detect the information transmission, and resuming advancement of time slices for all nodes after the information transmission is completed.

19. The method to implement the no-stop electronic toll collection system of claim 18, wherein said carrier sensing the multiple access/collision avoidance protocol further includes automatically changing the competitive time slice of the first node which accesses the WLAN firstly in the time sequence into a priority time slot prior to other time slots, and transmitting the information of the first node firstly in the time sequence.

* * * * *